US006109824A

United States Patent [19]

Annès

[11] Patent Number: 6,109,824

[45] Date of Patent: Aug. 29, 2000

[54] ADJUSTABLE SEWER INLET SECTION

[76] Inventor: Jean-Claude Annès, 2495, Monseigneur Laflêche, Apt 10, Ste-Foy, Quebec, Canada, G1V 1J9

[21] Appl. No.: 08/939,618

[22] Filed: Sep. 29, 1997

[51] Int. Cl.[7] ..... E02D 29/14

[52] U.S. Cl. ..... 404/26; 404/25; 52/20

[58] Field of Search ..... 404/25, 26, 2, 404/3, 4, 5; 52/19, 20, 210, 219, 285

[56] References Cited

U.S. PATENT DOCUMENTS

| | | | |
|---|---|---|---|
| 33,538 | 10/1861 | Myers | 404/2 |
| 1,254,641 | 1/1918 | Adam | 404/25 |
| 1,978,491 | 10/1934 | Gladman | 404/2 |
| 2,791,792 | 5/1957 | Shearer, Sr. | 404/2 |
| 4,255,909 | 3/1981 | Soderstrom | 404/26 |
| 4,388,015 | 6/1983 | Honegger | 404/2 |
| 4,815,888 | 3/1989 | Stegmeier | 404/4 |
| 4,896,705 | 1/1990 | Podgers et al. | 52/20 |
| 4,906,128 | 3/1990 | Trudel . | |
| 4,936,703 | 6/1990 | Ferns | 404/25 |
| 5,051,022 | 9/1991 | Bowman . | |
| 5,192,156 | 3/1993 | Webb | 404/4 |
| 5,360,131 | 11/1994 | Phillipps et al. . | |
| 5,360,284 | 11/1994 | Allard | 52/21 |
| 5,470,172 | 11/1995 | Wiedrich | 52/19 |
| 5,525,006 | 6/1996 | Kilman et al. | 404/25 |
| 5,613,806 | 3/1997 | House et al. | 52/20 |

FOREIGN PATENT DOCUMENTS

| | | |
|---|---|---|
| 1068961 | 1/1980 | Canada . |
| 1270138 | 1/1990 | Canada . |
| 1287247 | 8/1991 | Canada . |
| 2151069 | 1/1997 | Canada . |

*Primary Examiner*—Eileen Dunn Lillis
*Assistant Examiner*—Raymond W Addie
*Attorney, Agent, or Firm*—Swabey Ogilvy Renault

[57] ABSTRACT

An adjustable sewer inlet section for collecting and directing surface water to an underground conduit of a sewer. The inlet section comprises an eccentric hollow member adapted to be adjustably rotated on the top of the underground conduit to adjust the position of a surface water receiving member relative to a reference line, even though the underground conduit has been misplaced. A non-rigid connector is provided for connecting the receiving member in flow communication with the underground conduit, while allowing relative movement of the receiving member with respect to the underground conduit. The receiving member is provided with an inwardly directed bottom wall adapted to ensure proper distribution of loads from the receiving member to the underlying ground material.

17 Claims, 3 Drawing Sheets

ADJUSTABLE SEWER INLET SECTION

BACKGROUND OF INVENTION

1) Technical Field

The present invention is directed to sewers and, more particularly, to an adjustable sewer inlet section for collecting and directing surface water drainage into a subterranean conduit.

2) Background Art

It is well known that most streets have openings which give access to vertical concrete cylinders leading to public services, namely aqueduct, energy and communications systems. While standards require the street draining well to be at a certain distance from the curb or the sidewalk, it is often difficult to locate the base of the street draining well so as to respect that distance.

Since all the components of a conventional street draining well system are stacked and do not allow for adjustments in position, it becomes impossible to obtain the required distance between the center of the grate and the sidewalk if the base is not positioned properly. In order to compensate for the bad positioning of the base, the upper components of the street draining well system will often be misaligned with respect to the base, This misalignment, in turn, will allow sewage water to infiltrate the street draining well system between the frame and the head, causing a premature erosion of the infrastructure supporting the roadway. The roadway surrounding the street draining well system then collapses, making the system both less efficient and dangerous. Furthermore, the infiltrated water freezes in the winter, causing an expansion of the ground surrounding the street draining well, and accelerating the degradation of its concrete components.

A depression in the roadway can frequently be seen around a street draining well. Asphalt roadways are almost watertight. Therefore, if the joint between the street draining well and the road is watertight; the infrastructure should stay dry. Due to the design flaws of conventional systems, in time, cracks start to appear in the road and water infiltrates the infrastructure under the road, which then collapses around the street draining well. The deterioration of the road is also caused by traffic and by the inadequate compaction of the infrastructure is surrounding the street draining well at the time of installation. In the case of existing street draining wells, the frame is fixed on a non compressible base that is set on stable ground and no damping elements are used between the base and the rigid frame with conventional street draining wells, we cannot compact the infrastructure without going around the sections of the street draining well. It is difficult, even impossible, to compact the infrastructure uniformly so that it stays stable with time. In time, the road collapses around the grate, which stays in place because it is fixed to a solid base.

Existing patents do not in any way resolve simply and efficiently the following frequently-encountered problems when installing street draining wells: unequal and deficient compaction of the infrastructure around the street draining well, incorrect inclination and alignment of the components of the street draining well with respect to the roadway, damages to the road and concrete components, non-conformity with public service requirements.

Canadian patent 1,068,961 discloses a sewer structure with threaded rods for adjusting the height and angle of a grate. Tools are required to adjust the position of the grate.

U.S. Pat. No. 5,470,172 and Canadian patent 2,151,069 discloses a sewer structure allowing for the adjustment of the height of a frame by adding a ring or multiple rings under the frame. A wedge may be inserted under the ring to set the inclination of the frame.

U.S. Pat. No. 4,906,128 and Canadian is patent 1,287,247 disclose structures which allow for the adjustment of the height of a grate. This is accomplished with a rod which is jagged and fixed in place by a protuberance.

U.S. Pat. No. 5,360,131 discloses a structure having two rings with inwardly projecting rectangular protuberances of different heights to allow the grate to attain the required height and slope by rotating the upper ring relative to the lower ring.

U.S. Pat. No. 5,051,022 discloses a structure that has a frame with a fixed sloped surface requiring different models to fit the different inclinations of the road.

Canadian patent 1,270,138 discloses a manhole with a movable cover that cannot be adjusted either in height or in inclination once installed.

In conclusion, some problems can only be partially solved by the aforementioned patents.

SUMMARY OF THE INVENTION

It is therefore an aim of the present invention to provide an adjustable sewer inlet section allowing for the adjustment of the lateral position of a receiving member with respect to a reference line.

It is a further aim of the present invention to provide an adjustable sewer inlet section adapted to move jointly with the surrounding infrastructure.

It is still a further aim of the present invention to provide an adjustable sewer inlet section which allows for substantially uniform compaction of the surrounding backfill material.

Therefore, in accordance with the present invention, there is provided an adjustable sewer inlet section for collecting and directing surface water drainage into a subterranean conduit, comprising a receiving member defining at least one opening for receiving the surface water, and a hollow member having first and second opposed end portions which are off-centered with respect to one another, said first end portion being adapted to be connected in flow communication with the subterranean conduit while allowing said hollow member to be adjustably rotated with respect to said subterranean conduit wherein said second end portion displaces in an orbit-like fashion about an axis of rotation of said hollow member, said receiving member being adapted to be connected in flow communication with said second end portion of said receiving member and being adjustable with respect thereto, whereby inaccurate positioning of the subterranean conduit is corrected by rotating the hollow member to displace the second end portion thereof to an adjusted position, thereby enabling the receiving member connected to said hollow member to be properly positioned with respect to a reference line.

In accordance with a further general aspect of the present invention, there is provided an adjustable sewer inlet section for collecting and directing surface water drainage into a subterranean conduit, comprising an unfastened receiving member freely set in a ground material at an angle relative to the subterranean conduit so that an upper edge thereof is substantially flush with a slope of a ground surface, said receiving member defining at least one inlet opening for receiving the surface water, and non-rigid connecting means for connecting said receiving member in flow communication with the subterranean conduit, whereby said receiving member can move in at least one of an axial and a radial direction with respect to the subterranean conduit due to ground shifting.

In accordance with a still further general aspect of the present invention there is provided an adjustable sewer inlet section for collecting and directing surface water drainage into a subterranean conduit, comprising a receiving member embedded in a ground material and defining at least one opening for receiving the surface water, and non-rigid connecting means for connecting said receiving member in flow communication with the subterranean conduit, said receiving member having a bottom wall adapted to direct collected surface water into the subterranean conduit and defining a pressure distribution surface adapted to transmit compression forces to backfill material located under said receiving member, whereby the backfill material is uniformly compacted by applying downward loads on and about said receiving member.

BRIEF DESCRIPTION OF THE DRAWING(S)

BEST MODE FOR CARRYING OUT THE INVENTION

Figure 1:
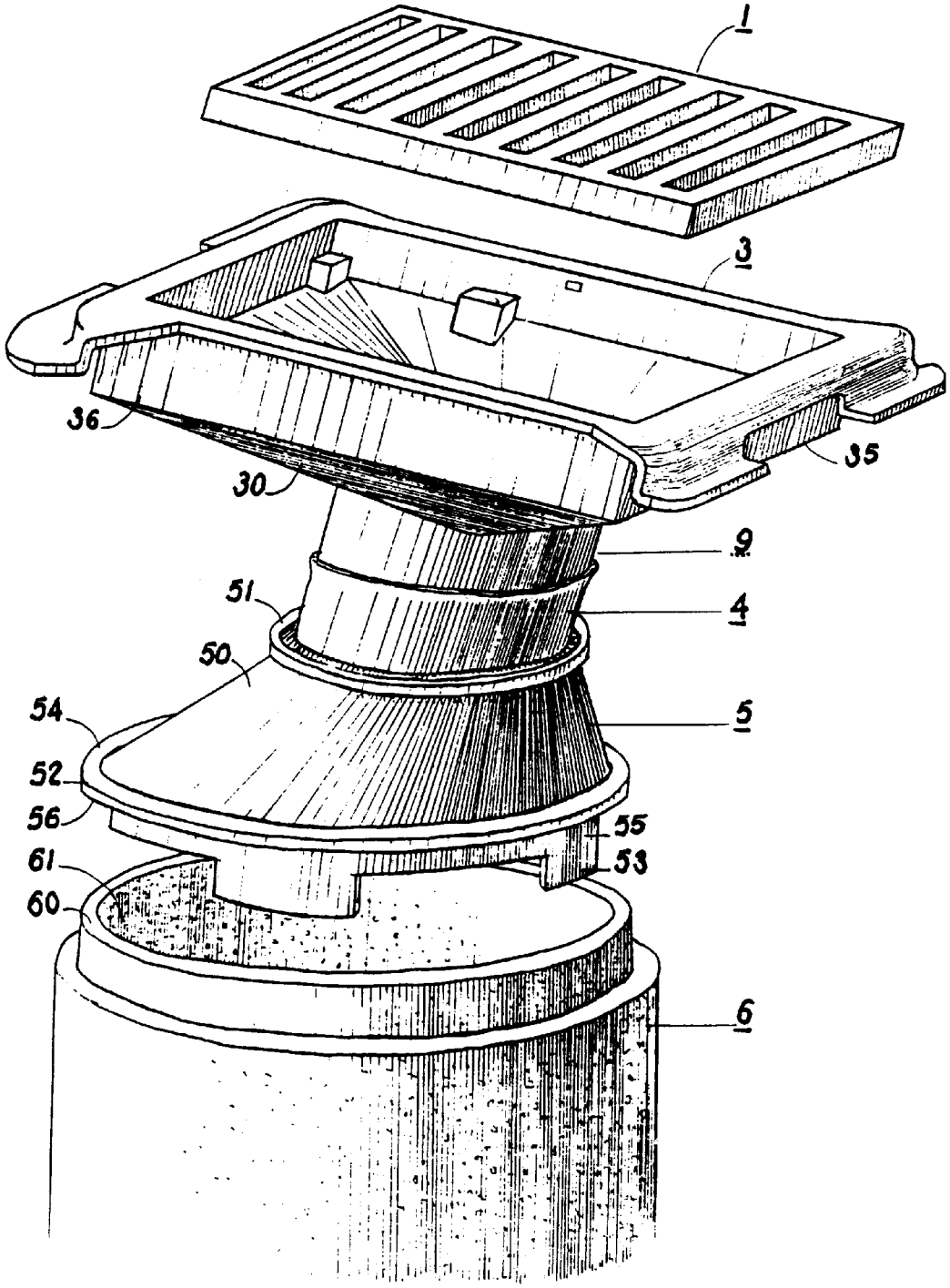
FIG. 1 shows an exploded perspective view of a sewer inlet section in accordance with a first embodiment of the present invention.

FIG. 1 illustrates a sewer inlet section 10 including a grate 1 that is set on a frame 3 having a shape which corresponds to that of grate 1. The shape of the grate 1 may be rectangular, circular or of any other suitable shape. The grate 1 and the frame 3 form a receiving member for collecting and directing surface water into an underground sewer (not shown). The frame 3 is provided with vertical walls 35 and 36 which merge with an inwardly and downwardly projecting bottom wall 30 which, in turn, merges with an evacuation conduit 9 or discharge section. A hollow member in the form of a cone shaped cast head which is oblique, hollow and truncated sits on a cylindrical concrete base 6. The head 5 defines upper and lower openings 51 and 52. The center of the upper opening 51 does not correspond to that of the lower circular opening 52. This allows the grate 1 to take different positions upon rotation of the head 5 about the central longitudinal axis or axis of symmetry 66 of the base 6. The transversal distance of the grate 1 with the axis of symmetry 66 is at least equal to the eccentricity 65 of the head 5. This set of positions of 360 degrees optimizes the position of the grate 1 relative to a reference line, such as a curb or sidewalk. An expansion joint 4 made of a soft rubber is slipped around the evacuation conduit 9. The bottom of the inclined surface 50 of the head 5 is limited by the horizontal surface 56 of a ring 54 sitting on the upper end 60 of the base 6. To avoid horizontal movements of the head 5 relative to the base 6, three vertical walls 53 shaped as arches are uniformly distributed on the circumference of the ring 54, under the circular junction of the inclined wall 50 and the ring 54. The center of the arch of one of the walls 53 corresponds to the area of the highest inclination of the head 5. The external wall 55 of the vertical walls 53 slides on the wall 61 of the base 6. The grate 1 is confined on all its thickness by the four vertical walls 35 and 36 that surround it when it is placed on the frame 3.

Figure 2:
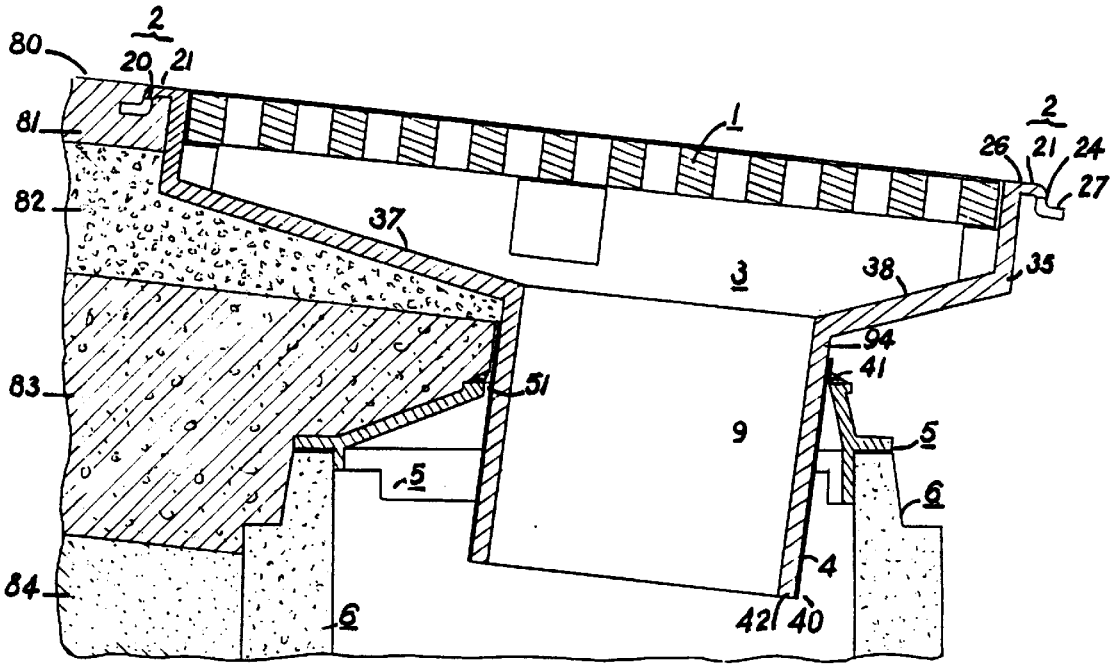
FIG. 2 is a cross-sectional view of the sewer inlet section installed in different layers of the infrastructure of a road.

As shown in FIG. 2, the sewer inlet section 10 is adapted to be set in an infrastructure composed of various layers 81, 82, 83 and 84. Supports 2, with horizontal levels 26 and 27, which are related by a vertical wall 24, extend from the superior circumference of the internal and vertical walls 35.

The frame 3 sits on these supports 2 when installed on the infrastructure of the road 81 and 82. The frame 3 is "floatingly" embedded in the ground material. This allows for a proper positioning of the frame 3 at the required angle relative to the base 6, while at the same time ensuring conjoint movement of the frame 3 and the ground material in which it is installed. The rounded shape 21 deviates objects that collide with the frame 3, avoiding damages and movement of the frame 3 and the grate 1. An opening 20 is made in each support 2 to ensure a homogeneous spreading of the pavement material 81 under the horizontal levels 26 and 27 when surfacing the road 90. The inclination of the wall section 37 which forms part of the bottom wall 30, and which is always in the highest part of the road 80 is different from the inclination of the wall section 38 because the evacuation conduit 9 is not centered lengthwise with the frame 3.

The inclination of the wall section 38 is set in a way so that water is directed to the evacuation conduit 9 even if the frame 3 is inclined at its maximum (approximately 25 per cent). When the road 80 is horizontal, the frame 3 is positioned so that the axis of symmetry of the evacuation conduit 9 is vertical. When the road 80 is inclined, the plane of the top surface of the frame 3 is leveled with the plane of the top surface of the road 80 by giving an inclination to the frame 3. The bottom wall sections 37 and 38 define pressure distribution surfaces 37*a* and 38*a* at an interface with the underlying backfill material. The fact that the frame 3 is not rigidly connected to the head 5, which defines an entrance section of the base 6, allows loads to be applied directly on the frame 3 to compact the backfill material. The pressure distribution surfaces 37*a* and 38*a* ensure that the loads will be uniformly transmitted from the frame 3 to the backfill material. It is pointed out that the backfill material comprised between the frame 3 and the head 5 acts as a damper to absorb the various shock forces exerted on the frame 3.

The installation of a non-rigid connector, namely the expansion joint 4 is necessary to prevent the passage of the infrastructure 82 and 83 between the external wall 94 of the evacuation conduit 9 and the upper opening 51 of the head 5. One of the ends 40 of the joint 4 is fixed on the bottom circumference 42 at the inferior end of the evacuation conduit 9. The joint 4 is rolled up from its bottom section 93 on the external wall 94 of the evacuation conduit 9 at a distance determined by the position between the frame 3 and the head 5. What is left of the joint 4 is rolled over itself. The bottom section 42 of the other end 41 of the joint 4 is fixed about upper opening 51 of the head 5. To allow maximum up or down movements of the frame 3, the length of the joint 4 must be at least superior to the length of the evacuation conduit 9. The type of expansion joint 4 described is one of the solutions prescribed to connect of the head 5 to the evacuation conduit 9. In fact, the idea is to use a joint 4 which allows for movements of the frame 3 with respect to the head 5 and which will prevent infiltration of the infrastructure 82 and 83 between these two elements. The joint 4 and the evacuation conduit 9 are common to all types of frames 3 and grates 1 and can be adapted to all sizes of street draining well bases 6.

Figure 3:
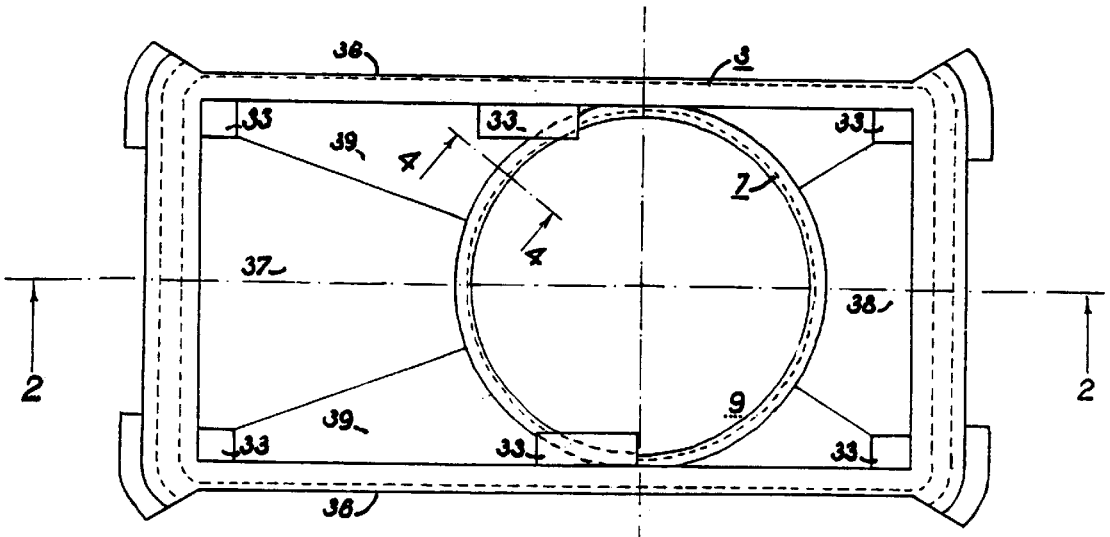
FIG. 3 shows a top view of the sewer inlet section.

As shown in FIG. 3, the evacuation conduit 9 has an external diameter that is equal to the width of the smallest frame 3. When the frame 3 has a greater dimension, the external diameter of the evacuation conduit 9 remains the same as for the smallest frame. The frame 3 has six supports 33, four in each internal corner and two positioned across each other inside the two longitudinal, vertical walls 36 of the frame 3. The horizontal top surface of each support 33 is positioned in a way that the top of the grate 1 corresponds to the superior section of the frame 3 when the grate 1 sits on its supports 33.

Figure 4:
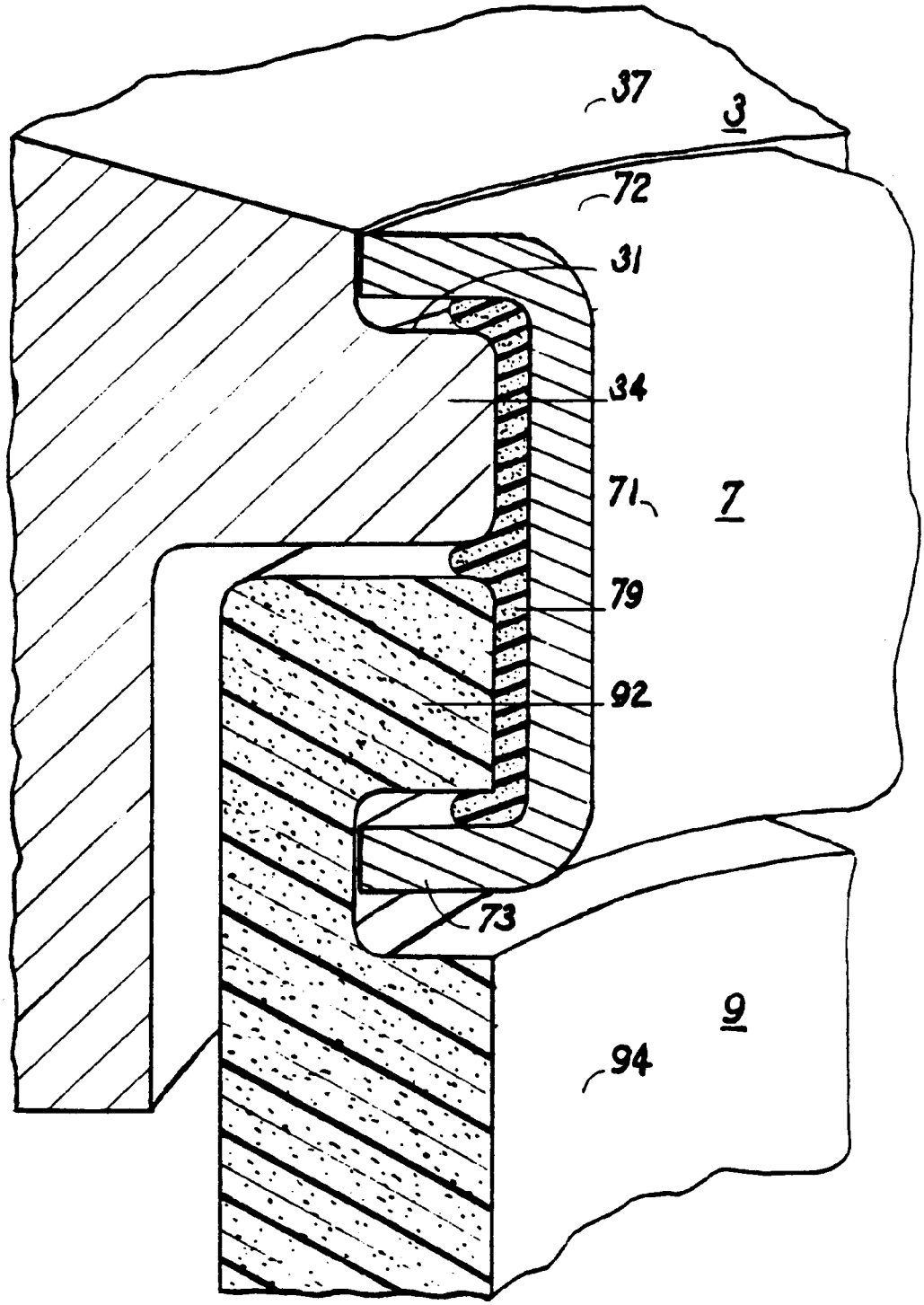
FIG. 4 shows an enlarged cross-sectional view of the sewer inlet section, showing the joint used to connect a discharge section with a surface water receiving member.

As shown in FIG. 4, an annular joint 7 connects the evacuation conduit 9 to the frame 3. The annular joint 7 has a flat U shape and is provided with an upper end 72 adapted to be the continuation of the inclined wall 37. The lower end 73 of the joint 7 is inserted in a groove located near the upper end 92 of the internal wall 94 of the evacuation conduit 9. The upper and lower ends 72 and 73 of the joint 7 are connected to each other via a vertical wall 70 having an internal surface 71 which is flush with the internal surface 94 of the evacuation conduit 9. This ensures adequate flow of the collected surface water. According to another embodiment of the present invention, the evacuation conduit 9 is integrally formed with the frame 3.

An annular protuberance 34 extends inwardly from the internal wall circumscribing the opening of the frame 3. The top surface 31 of the protuberance 34 is spaced from the lower opening of the frame 3 by a distance greater than slightly the thickness of the joint 7. The length of the top surface 31 is slightly less than the length of the end 72 of the joint 7. To optimize the evacuation of the water collected by the frame 3, the evacuation conduit 9 is longitudinally offset. A silicon type composite 79 or any other waterproof composite is applied between the joint 7 and the adjoining surface of the evacuation conduit 9 and frame 3.

What is claimed is:

1. An adjustable sewer inlet section for collecting and directing surface water drainage into a subterranean conduit, comprising a receiving member defining at least one opening for receiving the surface water, and a hollow member having first and second opposed parallel end portions which are off-centered with respect to one another, said first end portion being able to be connected in flow communication with the subterranean conduit while allowing said hollow member to be adjustably rotated with respect to said subterranean conduit wherein said second end portion displaces in an orbit-like fashion about an axis of rotation of said hollow member, said receiving member being able to be connected in flow communication with said second end portion of said receiving member and being adjustable with respect thereto, whereby inaccurate lateral positioning of the subterranean conduit is corrected by rotating the hollow member to displace the second end portion thereof to a lateral adjusted position, thereby enabling the receiving member connected to said hollow member to be properly laterally positioned with respect to a reference line.

2. An adjustable sewer inlet section as defined in claim 1, wherein said axis of rotation coincides with a longitudinal symmetry axis of the subterranean conduit.

3. An adjustable sewer inlet section as defined in claim 1, wherein said receiving member and said hollow member are interconnected by non-rigid connecting means for allowing angular and longitudinal movements of said receiving member relative to said hollow member.

4. An adjustable sewer inlet section as defined in claim 3, wherein said receiving member includes a tubular discharge section projecting downwardly into said second end portion of said hollow member, and wherein said non-rigid connecting means form a barrier to prevent backfill materials from falling into the second end portion of the hollow member, while allowing said tubular discharge section to assume various longitudinal and angular positions relative to said second end portion.

5. An adjustable sewer inlet section as defined in claim 4, wherein said receiving member is embedded in a surrounding infrastructure of a ground surface for movement therewith and wherein said hollow member is supported by the subterranean conduit, whereby said receiving member is allowed to be displaced with respect to said hollow member and to the subterranean conduit in response to movements of the ground surface.

6. An adjustable sewer inlet section as defined in claim 4, wherein said hollow member has inside dimensions which increase from said second end portion thereof.

7. An adjustable sewer inlet section as defined in claim 5, wherein said tubular discharge section extends downwardly from a bottom wall of said receiving member, said bottom wall defining at an interface with the backfill material a pressure distribution surface adapted to transmit compression forces to the backfill material comprised between said bottom wall and said hollow member, whereby the backfill material is uniformly compacted by applying downward loads on and about said receiving member.

8. An adjustable sewer inlet section as defined in claim 5, wherein said receiving member includes a frame adapted to support a grate, said frame having an upper edge from which lateral flange means extend outwardly, said lateral flange means having a distal end portion disposed at a level below said upper edge.

9. An adjustable sewer inlet section as defined in claim 6, wherein said receiving member includes side wall means, and wherein said bottom wall extends inwardly and downwardly of said side wall means so as to direct surface water in said tubular discharge section.

10. An adjustable sewer inlet section as defined in claim 7, wherein said tubular discharge section is removably connected to said bottom wall.

11. An adjustable sewer inlet section as defined in claim 7, wherein said tubular discharge section has an inlet opening which is eccentric relative to said bottom wall.

12. An adjustable sewer inlet section for collecting and directing surface water drainage into a subterranean conduit, comprising an unfastened rigid receiving member freely set in a ground material and supported thereby at an angle relative to the subterranean conduit so that an upper edge thereof is substantially flush with a slope of a ground surface, said rigid receiving member being spaced from said subterranean conduit so as to define a play therewith to allow relative angular movement between said rigid receiving member and said subterranean conduit, said rigid receiving member defining at least one inlet opening for receiving the surface water, and non-rigid connecting means for connecting said rigid receiving member in flow communication with the subterranean conduit, whereby said rigid receiving member can move in at least one of an axial and a radial direction with respect to the subterranean conduit due to ground shifting.

13. An adjustable sewer inlet section as defined in claim 12, wherein said rigid receiving member comprises a tubular discharge section extending downwardly into an opening defined at an upper end of an entrance section of the subterranean conduit, said tubular discharge section being sufficiently smaller than said opening to allow said rind receiving member to be disposed at various angular positions with respect to the subterranean conduit, and wherein said entrance section is surrounded by ground material.

14. An adjustable sewer inlet section as defined in claim 12, wherein said non-rigid connecting means include a flexible barrier disposed to prevent backfill material from falling into the subterranean conduit.

15. An adjustable sewer inlet section as defined in claim 13, wherein said entrance section has inside dimensions which increase from said upper end so as to avoid interference with angular displacements of said tubular discharge section within said entrance section.

16. An adjustable sewer inlet section as defined in claim 13, wherein said tubular discharge section depends eccentrically from a bottom wall of said receiving member, said bottom wall being configured to direct surface water into said tubular discharge section.

17. An adjustable sewer inlet section as defined in claim 13, wherein said entrance section is formed by a hollow member disposed on the subterranean conduit.

* * * * *